US006963040B1

(12) United States Patent
Urman

(10) Patent No.: US 6,963,040 B1
(45) Date of Patent: Nov. 8, 2005

(54) ILLUMINATED TOUCH SWITCH

(75) Inventor: Robert Urman, Schaumburg, IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/892,596

(22) Filed: Dec. 6, 2004

(51) Int. Cl.[7] ..... H01H 9/00
(52) U.S. Cl. ..... 200/310; 200/314
(58) Field of Search ..... 200/5 A, 600, 200/512–519, 308–317; 307/112–116; 345/173, 345/176; 361/271, 288, 286; 341/22

(56) References Cited

U.S. PATENT DOCUMENTS 4,246,494 A * 1/1981 Foreman et al. ..... 307/116
5,118,910 A * 6/1992 Duhon et al. ..... 200/86 R
5,876,106 A * 3/1999 Kordecki ..... 362/29
6,664,489 B2 * 12/2003 Kleinhans et al. ..... 200/313
6,713,897 B2 * 3/2004 Caldwell ..... 307/125
6,734,377 B2 * 5/2004 Gremm et al. ..... 200/5 R
6,737,596 B1 * 5/2004 Hein ..... 200/310
6,750,407 B2 * 6/2004 Song et al. ..... 200/5 A
6,824,321 B2 * 11/2004 Ward et al. ..... 400/479

FOREIGN PATENT DOCUMENTS

JP 2000057873 A * 8/1998

* cited by examiner

*Primary Examiner*—Elvin G. Enad
*Assistant Examiner*—Lisa Klaus
(74) *Attorney, Agent, or Firm*—James Ray & Associates

(57) ABSTRACT

An illuminated touch switch has a touch sensitive area and a plurality of light emitting diodes arranged in a predetermined pattern. The touch switch includes a first rigid circuit board with a first electrical conductor and a second flexible circuit board with a second electrical conductor separated by a spacer of a predetermined thickness. Both conductors are aligned with the touch sensitive area and are coupled from the applied pressure providing an output signal. Light emitting diodes illuminate a single color light to indicate an enabled condition of the touch sensitive area.

30 Claims, 5 Drawing Sheets

ILLUMINATED TOUCH SWITCH

FIELD OF THE INVENTION

The present invention relates, in general, to an illuminated touch activated switch device and, more particularly, the instant invention relates to an illuminated touch activated switch device of a membrane type construction and, still more particularly, the instant invention relates to an illuminated touch activated switch device for use in a transit vehicle.

BACKGROUND OF THE INVENTION

The following background information is provided to assist the reader to understand the environment in which the invention will typically be used. The terms used herein are not intended to be limited to any particular narrow interpretation unless specifically stated otherwise in this document.

It is well known that pressure activated switches have been used in a variety of safety and equipment control applications. For example, U.S. Pat. No. 4,088,856 entitled "Perimeter Safety Switch Mounted To Support Disposed Remote From The Machine Body" teaches a perimeter safety switch, commonly known as a tape switch, that is accessible from any point of operation of the machine, and which can be actuated other than with the operator's hands. More specifically, the perimeter safety switch comprises a continuous longitudinal switch capable of being actuated at any point over its length, which is mounted on a bracket extending around the periphery of the machine, or at least around all areas which are accessible to the operator. If the operator is injured, either the operator himself or a co-worker can immediately stop the machine by a hand, leg or lower torso without searching for a switch which is remote or inaccessible, thus reducing the possibility of further injury and panic.

In another example, U.S. Pat. No. 4,995,639 entitled "Vehicle Crush Zone Crash Sensor" teaches a tape or ribbon switch technology as a crash switch used to sense and initiate deployment of an air bag passive restraint system. The sensor is responsive to trigger the passive restraint system when the vehicle impacts with a barrier which causes vehicle elements in the crush zone to deform as far back as the sensor position.

Pressure activated switches are also used for opening of doors in a transit vehicle. They are typically affixed along the leading edge of the door panel and are easily accessible to the passenger's hands, arms, and upper torso. In such application, the driver of the transit vehicle remotely unlocks but does not open the door, which is considered as enabled for opening. At the same time either a light above the door or the switch will illuminate which will be interpreted by a passenger that a closed door can be now opened by activating the switch. It is preferable to illuminate the switch itself since use of the external light carries additional material and installation labor costs.

U.S. Pat. No. 5,118,910 entitled "Illuminated, Pressure-Actuated Switch" teaches a press-at-any-point type switch suitable for opening doors of a transit vehicle. The illumination is provided by a flexible, electro-luminescent planar lamp that is aligned with the actuation surface of the switch. The lamp receives power through electrical leads and provides continuous and constant illumination over the elongated actuation zone of the switch.

In some transit vehicle applications, it is required to maintain a continuous illumination of the switch but change color of such illumination when the door status changes from enabled to non enabled or vise versa. Generally, a green color light is used for enabled doors and a red color light is used for non-enabled doors. One disadvantage of the switch taught by U.S. Pat. No. 5,118,910 is that, as is well known, electro-luminescent planar lamps are capable of producing only one color. The second disadvantage is that an electro-luminescent planar lamp requires an inverter to convert the input electricity to the required AC electricity of the necessary frequency and voltage to operate the lamp. The third disadvantage is associated with the requirement for an external cover, particularly when subjected to the environmental elements such as moisture and dirt.

In transit vehicles which employ a contact-less sensing system for passenger detection, such as thought in U.S. Pat. No. 5,146,410, it is desirable to minimize the overall thickness of the switch devices in order to minimize protrusion of such device from the door surface and, more particularly, minimize unwanted echoes received by the sensors disposed within such contact-less sensing system.

As it can be seen from the above discussion, there is a need to provide an illuminated touch activated switch that overcomes the disadvantages of the presently used devices.

SUMMARY OF THE INVENTION

The present invention provides an illuminated touch switch having a touch sensitive area and a plurality of light emitting diodes arranged in a predetermined pattern. A first circuit means, being a rigid printed circuit board, has a first electrical conductor aligned with the touch sensitive area. The second circuit means, being a flexible printed circuit board manufactured from a polyester material, has a second electrical conductor which is aligned with the first electrical conductor. A spacer of a predetermined thickness is disposed intermediate the first circuit means and the second circuit means for maintaining a predetermined distance between the pair of electrical conductors. The plurality of light emitting diodes and a pair of conductors are connected to a control circuit which enables illumination of the diodes and transmittal of the switch signal upon conductor coupling. The control circuit includes diodes for reverse polarity protection and resistors for supplying a predetermined current to the light emitting diodes. All components are surface mounted to the first circuit means and connected via printed board traces. The control circuit may be configured to receive a plurality of operating voltages. A cover having complimentary apertures either directly applied over the second circuit means or separated by a gasket. A second gasket is applied between the first circuit means and the mounting surface.

OBJECTS OF THE INVENTION

It is, therefore, one of the primary objects of the present invention to provide an illuminated touch switch device.

It is another object of the present invention to provide an illuminated touch switch device which does not require an AC inverter.

It is yet another object of the present invention to provide an illuminated touch switch device which provides multi-color illumination.

It is a further object of the present invention to provide an illuminated touch switch device which has a planar surface profile.

It is yet a further object of the present invention to provide an illuminated touch switch device capable of operating under a plurality of voltages.

It is additional object of the present invention to provide an illuminated touch switch device which incorporates protection from external environmental factors.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing figures and with the appended claims.

Figure 1:
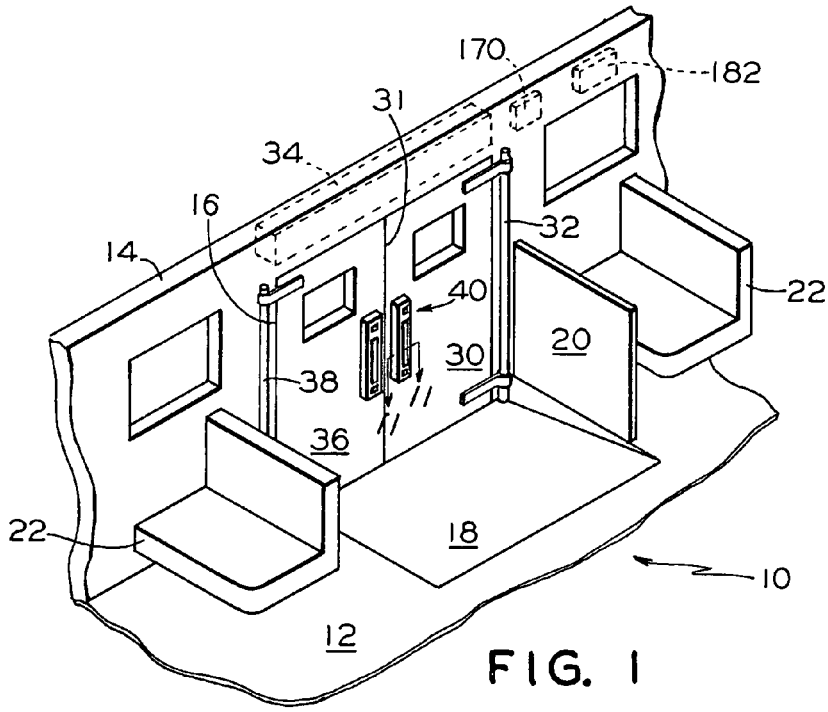
FIG. 1 is a partial perspective view of a transit vehicle.

DESCRIPTION OF THE PRESENTLY PREFERRED AND VARIOUS ALTERNATIVE EMBODIMENTS OF THE INVENTION

Before describing the invention in detail, the reader is advised that, for the sake of clarity and understanding, identical components having identical functions have been marked where possible with the same reference numerals in each of the Figures provided in this document.

The structure and operation of the present invention will be explained in combination with a door for a transit vehicle as use thereof in other applications will be obvious to those skilled in the relevant art form.

The reader's attention is directed to FIG. 1 illustrating a portion of a transit vehicle, generally designated 10, having a floor member 12 and a wall member 14. A door 30 is disposed within wall aperture 16 for at least partially covering and uncovering such wall aperture 16. The door 30 is supported by a door support means 32 and is connected to a door drive 34 for movement in one of opening and closing direction. Alternatively, such door support means 32 may be integral to door drive 34. A floor portion 18 adjacent the door 30 may be constructed as a flat inclined surface or constructed as a well-known stairwell.

Alternatively, such floor portion 18 may incorporate a movable accessibility device (not shown) which extends outwardly from the wall member 14 to accommodate ingress and egress of passengers with disabilities or needing further assistance. A screen member 20 may be provided within the transit vehicle 10 for separating a seating area 22 from the area defined by the door 30 and floor portion 18. A second door 36 supported by a door support means 38 may be disposed within the wall aperture 16 adjacent the first door 30. In such arrangement, the first door 30 and the second door 36 move in opposite directions for covering and uncovering wall aperture 16.

A touch switch, generally designated 40, of the present invention, best illustrated in FIGS. 2–11, is typically attached to the door 30 along and adjacent a leading edge 31 thereof for initiating the opening of such door 30 by a passenger. In a transit vehicle 10 employing a dual door configuration, a second touch switch 40 may be attached to the second door 36. Those skilled in the art will further appreciate that the touch switch 40 may be attached to the screen member 20 or may be disposed within floor portion 18.

Figure 2:
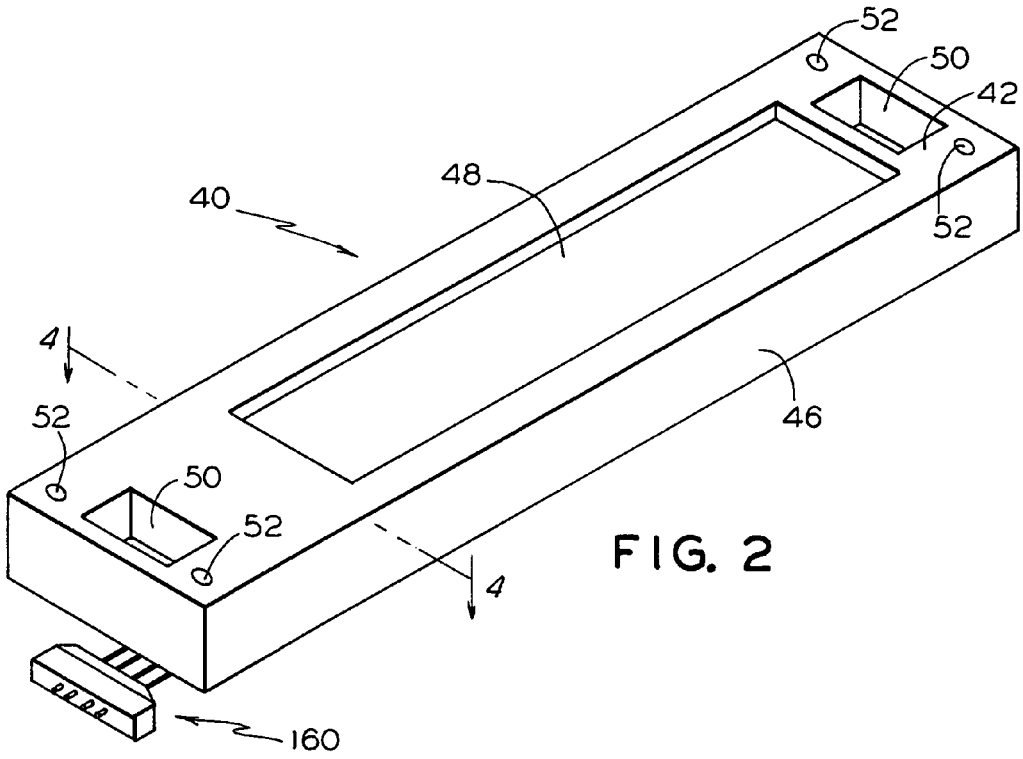
FIG. 2 is a perspective view of the touch switch of the present invention.

In reference to FIG. 2, the touch switch 40 includes a top surface 42 and an opposite bottom surface 44 which are joined by a perimeter edge 46. Preferably, such top surface 42 and such bottom surface 44 are substantially planar. A touch sensitive area 48 of a predetermined area is accessible by the passenger through the top surface 42. At least one illumination means 50 is visible through the top surface 42. In the preferred embodiment such at least one illumination means 50 is a plurality of illumination means 50 disposed at least at each end of the touch switch 40. At least one, but preferably a plurality of mounting means 52 is provided for attachment of the touch switch 40 to a rigid surface, such as, a door 30, screen 20, floor portion 18 or any other suitable mounting surface.

Figure 3:
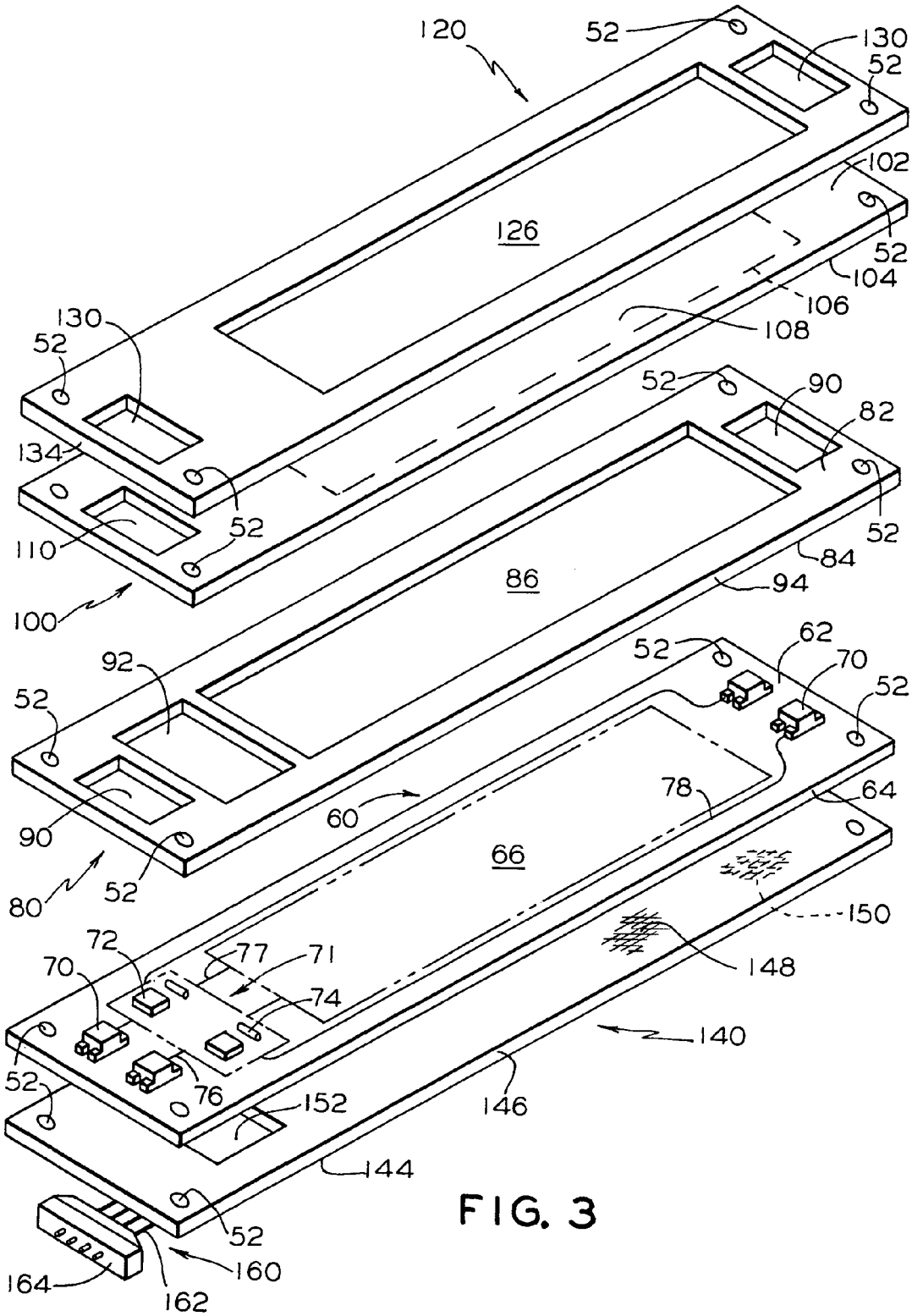
FIG. 3 is a exploded perspective view of the touch switch according to the instant invention.
Figure 9:
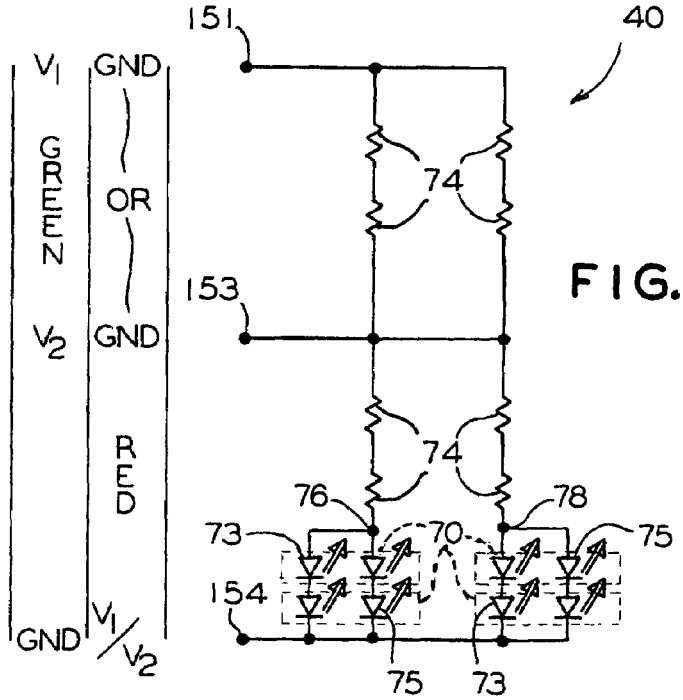
FIG. 9 is a schematic diagram of the control circuit particularly showing application of bi-color light emiting diodes of the alternative embodiment.

In further reference to FIG. 3, the first essential element of the present invention is a first circuit means, generally designated 60, having a top surface 62 and oppositely disposed bottom surface 64. Preferably, such top surface 62 and such bottom surface 64 are substantially planar. A first electrical conductor means 66 of a first predetermined area and a first predetermined pattern is disposed on the top surface 62. Preferably, such first circuit means 60 is a rigid printed circuit board 60 and such first electrical conductor means 66 is at least one well known electrical conductor trace 66 printed on the top surface 62 in the first predetermined pattern. At least one light source, preferably a light emitting diode, hereinafter referred to as LED, 70 is rigidly attached to the top surface 62. Such at least one LED 70 could be attached by a conventional through hole method but preferably the at least one LED 70 is an ultra-thin surface mount device as available from Nicomatic North America and attached by any well known surface mount methods. It has been determined that to meet illumination intensity requirements, such at least one LED 70 is best disposed as a pair of the LEDs 70 at each end of the first circuit means 60. It will be appreciated that a bicolor LED 70 capable of illuminating a green light to indicate the door 30 enabled for opening and further capable of illuminating a red light to indicate such door 30 in the closed and locked condition may be used in transit applications having this requirement. Such bicolor LED 70, as best shown in FIG. 9, is manufactured by a combination of a green portion 73 and a red portion 75 disposed within the same enclosure.

Figure 5:
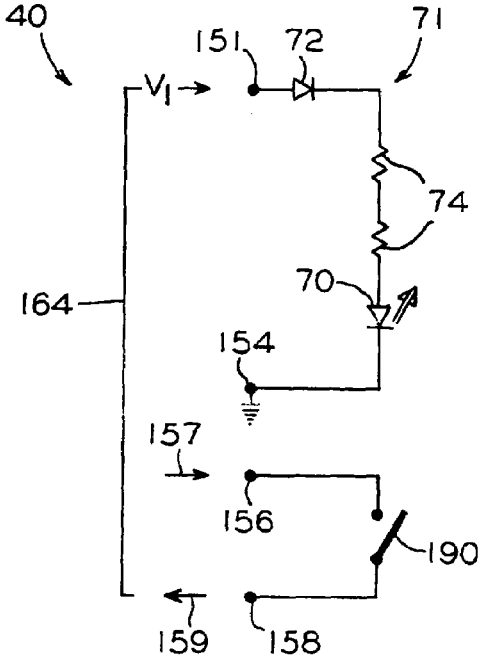
FIG. 5 is a schematic diagram particluraly showing a first embodiment of the control circuit of the present invention.

As further illustrated in FIGS. 3 and 5, the first electrical conductor means 66 and at least one LED 70 are electrically connected to a control circuit means, generally designated 71, by a plurality of electrical connections which are printed conductor trace elements 76, 77, and 78. The control circuit means 71 incorporates at least one diode 72 disposed in series with such at least one LED 70 for providing a reverse polarity protection and an at least one resistor 74 disposed intermediate such at least one diode 72 and such at least one LED 70 for providing a predetermined current. The control circuit means 71 further incorporates, at least one voltage source means 151 being an electrical connection 151, at least one electrical ground source means 154 being an electrical connection 154, at least one switch power source means 156 being an electrical connection 156 and at least one switch output source means 158 being an electrical connection 158.

An external electrical connection means, generally designated 160, electrically coupled to the first circuit means 60 is provided for supplying at least one voltage signal $V_1$ to the at least one voltage source connection 151, a ground signal GND to the at least one electrical ground source connection 154 and a switch power signal 157 to the at least one switch power source connection 156 for communicating at least one switch output signal 159 from the at least one switch output source connection 158.

It will be appreciated that at least one distinct voltage $V_1$ received at a first voltage source connection 151 in combination with a ground signal GND received at least one ground electrical connection 154 will generate a predetermined current through the at least one resistor 74 and, more particularly, will enable at least one LED 70 to illuminate a single color light.

Figure 10:
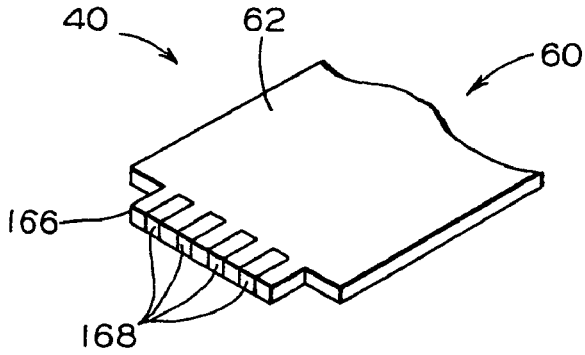
FIG. 10 is partial perspective view of the touch switch of the present invention particularly showing an electrical connection means of the alternative embodiment.

Preferably, such external electrical connection means 160 comprise a plurality of electrical wires 162, either disposed independently or being incorporated into a wire harness. The external end of each wire is preferably bare. Alternatively, such external end may be terminated with a terminal connection. Yet alternatively, at least one connector means 164 being either male pin or female socket type electrical connector 164 may be attached to the external end of such electrical connection means 160 for cooperating with the at least one mating connector (not shown) disposed within the door 30 or the transit vehicle 10. Such at least one connector means 164 may be secured directly to the first circuit means 60 by being coupled to a plurality of internal electrical connections disposed within control circuit means 71 which are associated with each of the source means. Yet alternatively, as best illustrated in FIG. 10, such at least one connector means 164 may be a well known edge connector 166 having a plurality of contact pads 168.

Figure 6:
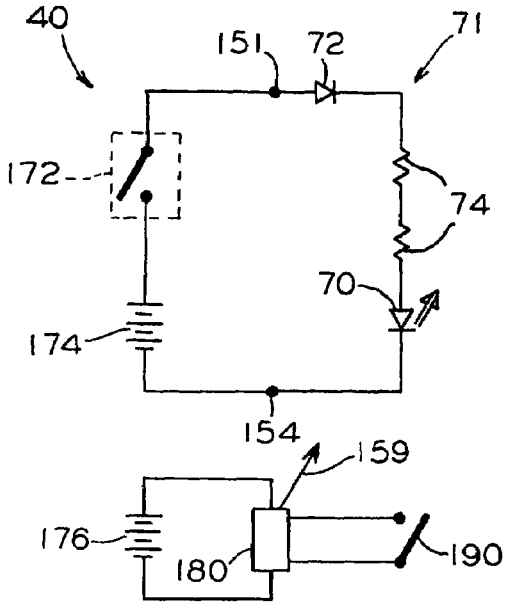
FIG. 6 is a schematic diagram particluraly showing a second embodiment of the control circuit of the present invention.
Figure 7:
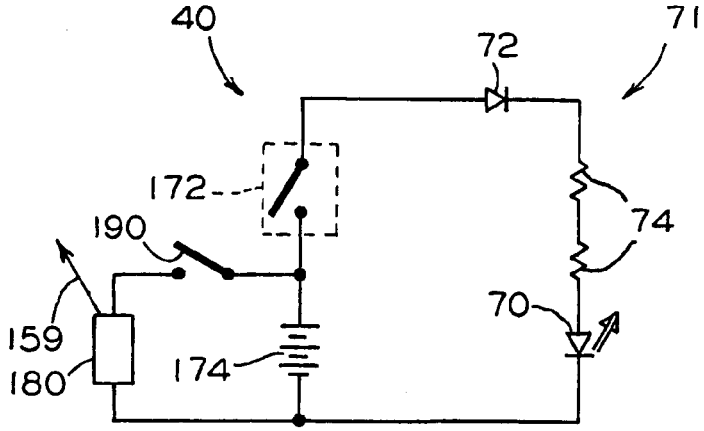
FIG. 7 is a schematic diagram particluraly showing a third embodiment of the control circuit of the present invention.

FIGS. 6 and 7 illustrate alternative embodiments of the control circuit means 71 enabling minimizing or eliminating the number of external electrical connections to the touch switch 40. In particular reference to FIG. 6, the power to at least one LED 70 is provided by a first battery source 174 and the receiver 172 which receives a wireless signal from a remotely disposed transmitter 170. The at least one switch output signal 159 is wirelessly transmitted by a transmitter 170 which is disposed within control circuit means 71 to a receiver 172 remotely mounted within the transit vehicle 10. In such embodiment, a second battery source 176 is provided for supplying the switch power signal 157 to the first electrical conductor means 66 and to the transmitter 170.

In a particular reference to FIG. 7, a single battery source 174 may be used to enable illumination of at least one LED 70 and transmittal of the at least one switch output signal 159.

Figure 8:
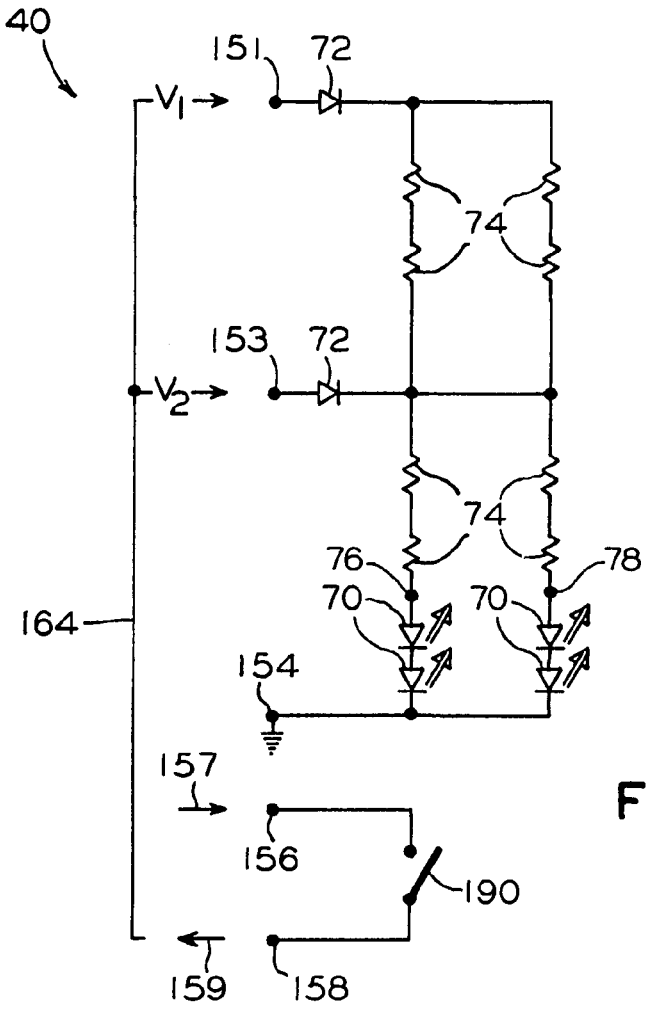
FIG. 8 is a schematic diagram particluraly showing the prefered embodiment of the control circuit of of the instant invention.

FIG. 8 illustrates a control circuit means 71 of the most preferred embodiment adapted for receiving a pair of two distinct direct current (DC) voltages $V_1$ at a first voltage source connection 151 and $V_2$ at a second voltage source connection 153 and a plurality of resistors 74 to illuminate a single color light from at least one LED 70. The value of the plurality of resistors 74 are selected based on value of the pair of two distinct direct current (DC) voltages $V_1$ and $V_2$ and to provide a predetermined current to plurality of LED 70.

FIG. 9 illustrates an alternative embodiment of the control circuit means 71 adapted for receiving a pair of two distinct direct current (DC) voltages $V_1$ and $V_2$ and for illuminating at least one bicolor LED 70. Those skilled in the art will readily understand that a pair of voltages $V_1$ and $V_2$ and ground GND will be applied according to the control circuit arrangement in FIG. 8 to illuminate green color portion 73, while a reversal of connections for voltage and ground supply will illuminate a red color portion 75. Those skilled in the art will further understand that the present invention will not require an AC inverter to illuminate at least one LED 70.

It will be appreciated that additional voltage source connections may be provided to the control circuit arrangement of FIGS. 5 through 9 for enabling operation of the touch switch 40 under various voltage conditions applicable to various types of the transit vehicle 10. It will be further appreciated that such diodes 72 and resistors 74 may be mounted external to the touch switch 40, however, integral mounting of such components offers manufacturing cost advantages.

Another essential element of the present invention is a second circuit means, generally designated 100, having an upper surface 102 and a bottom surface 104. Preferably, such top surface 102 and such bottom surface 104 are substantially planar. A second electrical conductor means 106 of a second predetermined area and a second predetermined pattern is disposed on the bottom surface 104 in alignment with the first electrical conductor means 66.

The second circuit means 100 may be a rigid printed circuit board having a flexible second electrical conductor means 106 disposed therein but, preferably, such second circuit means 100 is manufactured from a well-known flexible polyester material such as Mylar having a pattern of printed second electrical conductor means 106.

The second circuit means 100 further incorporates at least one clear portion 110 in alignment with at least one LED 70 for enabling visual recognition thereof when a spacer means, generally designated 80, is thicker than any one of the surface mount electrical components. Alternatively, such at least one portion 110 may be an aperture 110 when such spacer means 80 is of a smaller thickness.

Preferably, the top surface 102 is coated with an anti-graffiti material to resist vandalism. Additionally, a text or graphic indicia portion 108 may be printed on the top surface 102 or applied as a label for providing additional operational instructions to the passengers.

The spacer means 80 of a predetermined thickness 94, best illustrated in FIG. 3, is disposed between the top surface 62 of the first circuit means 60 and the bottom surface 104 of the second circuit means 100 for separating the first electrical conductor means 66 from a second electrical conductor means 106 to prevent unwanted self activation of the touch switch 40. The spacer means 80 has a first aperture 86 which is in alignment with the first electrical conductor means 66, at least one second aperture 90 for fitting around the at least one LED 70, a third aperture 92 aligned with the placement of the control circuit means 71 and at least one mounting aperture 52. Preferably, the predetermined thickness 94 is at least equal or greater than the largest thickness of the at least one LED 70, at least one diode 72 or at least one resistor 74 enabling such components to be disposed at least even and preferably below a top surface 82 of the spacer means 80. It will be appreciated that the predetermined thickness 94 may be smaller than the thickness of the components with clearance provisions incorporated into other elements of the touch switch 40 as will be explained below.

Preferably, such spacer means 80 is manufactured from acrylic adhesive, although such acrylic adhesive may be separately applied to the top surface 82 and a bottom surface 84.

A cover member, generally designated 120, may be provided for housing the first and second circuit means 60 and 100, respectively, and the spacer means 80. Such cover member 120 will incorporate an aperture 126 enabling access to the touch sensitive area 48, at least one mounting aperture 52 and at least one LED aperture 130.

Figure 4A:
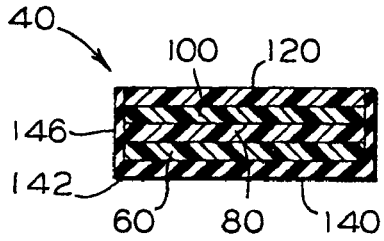
FIGS. 4A–4C contain cross-sectional views of the edge sealing means of preferred and alternative embodiments along lines 4—4 in FIG. 2.

A sealing means, generally designated 140, may be provided between a surface of the door 30 and the bottom surface 64 of the first circuit means 60. Preferably, such sealing means 140 is manufactured from molded silicone material and includes an edge sealing means being a perimeter edge 146 which extends outwardly from the surface 142 of the sealing means 140 to the bottom side of the cover member 120 for capturing and sealing the essential elements of the present invention as best illustrated in FIG. 4A.

The sealing means 140 prevents cleaning agents and environmental factors, such as moisture and dirt, from affecting the operation of the touch switch 40. The sealing means 140 further prevents environmental factors from entering the door cavity (not shown) which is aligned and cooperates with an aperture 152 for enabling routing of the external electrical connection means 160 and its connection with the complimentary vehicle wiring (not shown) typically disposed within door 30.

Additionally, such sealing means 140 will compensate for variations in flatness tolerances of the door 30.

Figure 4B:
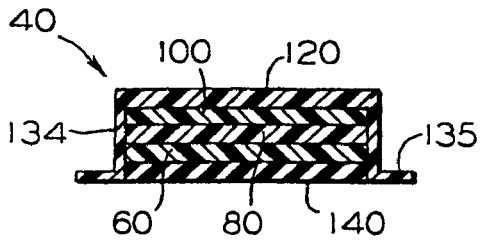
Figure 4C:
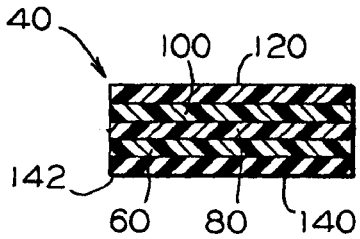

Alternatively, the cover member 120 may incorporate a perimeter flange 134 as best illustrated in FIG. 4B functioning as an edge sealing means. Yet alternatively, at least the edges of the first and second circuit means 60 and 100, respectively, and the spacer means 80 may be sealed with a well known epoxy material 146 as best illustrated in FIG. 4C. In combination with alternative embodiments of FIGS. 4B and 4C, the sealing means 140 is manufactured from a rubberized compound such as neoprene or EPDM and has an adhesive 148 applied to the surface 142 for bonding to the bottom surface 64 of the first circuit means 60. Additionally, adhesive 150 may be applied to the bottom surface 144 for a permanent or a semi-permanent attachment to the door 30 or any other rigid mounting surface.

In applications where such touch switch will be exposed to moisture, a second sealing means 140 may be disposed intermediate a second electrical circuit means 100 and a cover member 120. It will be understood that such second sealing means 140 will include a plurality of apertures respectively aligned with the aperture 126, at least one mounting aperture 52 and at least one LED aperture 130.

Figure 11:
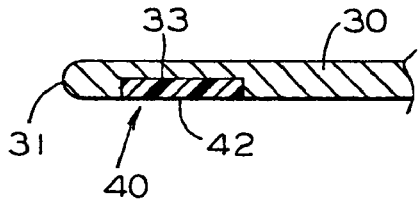
FIG. 11 is a partial cross-sectional view of the touch switch of the present invention along lines 11—11 in FIG. 1, particularly showing touch switch mounting of the alternative embodiment.

It will be appreciated that such planar construction of the touch switch 40 substantially minimizes the unwanted echoes received by the sensors of the contact-less sensing systems for passenger detection. To further eliminate such unwanted echoes, the touch switch 40 may be recessed within a door switch cavity 33 of predetermined size and thickness as best illustrated in FIG. 11.

It will be understood that the touch sensitive area 48 is provided by a combination of the first electrical conductor means 66, the second electrical conductor means 106, the first aperture 86 of the spacer means 80, and the aperture 126 of the cover means 120. It will be appreciated that the pattern of each of the first electrical conductor means 66 and the second electrical conductor means 106 will be predetermined based on the area and configuration of the touch sensitive area 48. Such pattern may vary from a single conductor trace element to a plurality of conductor trace elements which are connected together and further having the first electrical conductor means 66 connected to the control circuit means 71 via trace element 77.

In the preferred embodiment at least one mounting aperture 52 formed by a combination of the aligned mounting apertures 52 is provided for attaching the touch switch 40 to a rigid surface. Alternatively the at least one mounting aperture 52 may be disposed within a mounting flange 135 of a cover member 120, as best illustrated in FIG. 4B.

In operation, the driver of the vehicle will provide at least one distinct voltage $V_1$ and at least one ground signal GND enabling illumination of the at least one LED 70. At the same time, the switch power signal 157 will be provided to the first electrical conductor means 66. The passenger who is waiting at the door 30 to egress the transit vehicle 10 will readily recognize the illumination of the touch switch 40 as the condition that the door is enabled for opening. The passenger will then apply touch pressure to any portion of the touch sensitive area 48 enabling the second electrical conductor means 106 to couple with the first electrical conductor means 66 producing the switch output signal 159 which will be used by the door drive 34 to move the door 30 in the opening direction. In FIGS. 5–8, such coupling effect will be represented by closure of the switch 190. In applications employing a bicolor at least one LED 70, such door enablement condition will be visually annunciated by light color changing from red to green.

The person skilled in the membrane switch art will readily understand that any commercially available or custom manufactured membrane switches may be utilized in the present invention by electrically connecting such membrane switch to the at least one LED 70 and the control circuit means 71 and packaging and installing the combination according to the described embodiments.

While the presently preferred embodiment of the instant invention has been described in detail above in accordance with the patent statutes, it should be recognized that various other modifications and adaptations of the invention may be made by those persons who are skilled in the relevant art without departing from either the spirit or the scope of the appended claims.

I claim:

1. An illuminated touch switch having a touch sensitive area, said illuminated touch switch comprising:

(a) a first circuit means having a top surface and oppositely disposed bottom surface;

(b) a second circuit means having a top surface and a bottom surface disposed opposite to said top surface of said first circuit means;

(c) a first electrical conductor means of a first predetermined area and a first predetermined pattern disposed on said top surface of said first circuit means in alignment with said touch sensitive area;

(d) a second electrical conductor means of a second predetermined area and a second predetermined pattern disposed on said bottom surface of said second circuit means in alignment with said first electrical conductor means;

(e) a spacer means of a first predetermined thickness disposed intermediate said first circuit means and said second circuit means for maintaining a predetermined distance between said first electrical conductor means and said second electrical conductor means, said spacer means having a plurality of apertures;

(f) at least one light source of a second predetermined thickness secured to said top surface of said first circuit means;

(g) a control circuit means secured to said first circuit means having at least one voltage source means electrically coupled to a positive lead of said at least one light source, at least one electrical ground source means electrically coupled to a negative lead of said at least one light source, at least one switch power source means electrically coupled to said first electrical conductor means, at least one switch output source means electrically coupled to said first electrical conductor means, at least one resistor means disposed intermediate said at least one voltage source means and said at least one light source, and a plurality of internal electrical connection means associated with each one of said source means;

(h) a means disposed within said illuminated touch switch for mounting thereof to a rigid surface;

(i) whereby application of at least one distinct voltage signal supplied to said at least one voltage source means in combination with at least one ground signal supplied to said at least one electrical ground source means provides electrical current to said at least one light source and causes it to illuminate at least one color light; and (j) whereby a touch contact pressure applied to said touch sensitive area couples said second electrical conductor means to said first electrical conductor means to transmit at least one switch output signal from said at least one switch output source means upon supply of a switch power source signal to said at least one switch power source means.

2. The illuminated touch switch according to claim 1 wherein said first circuit means is a printed circuit board.

3. The illuminated touch switch according to claim 2 wherein said printed circuit board is rigid.

4. The illuminated touch switch according to claim 1 wherein said first electrical conductor means is at least one electrical conductor trace printed on said top surface of said first circuit means in said first predetermined pattern.

5. The illuminated touch switch according to claim 1 wherein said at least one light source is at least one light emitting diode being one of a through hole and a surface mounted light emitting diode.

6. The illuminated touch switch according to claim 1 wherein said at least one light emitting diode illuminates one of a single and a dual color light.

7. The illuminated touch switch according to claim 1 wherein said at least one light source is a plurality of said light emitting diodes.

8. The illuminated touch switch according to claim 7 wherein said plurality of said light emitting diodes is four light emitting diodes disposed as pairs of said light emitting diodes at each opposite end of said first circuit means.

9. The illuminated touch switch according to claim 1 wherein said second circuit means is one of a rigid printed circuit board having a flexible second electrical conductor means and a flexible printed circuit board.

10. The illuminated touch switch according to claim 9 wherein said second circuit means is a flexible polyester material having a pattern of said second electrical conductor means printed thereon.

11. The illuminated touch switch according to claim 10 wherein said flexible polyester material is Mylar.

12. The illuminated touch switch according to claim 1 wherein said second circuit means includes at least one portion aligned with said at least one light source, said at least one portion being one of an aperture and a clear portion enabling visual recognition of said at least one light source.

13. The illuminated touch switch according to claim 1 wherein said top surface of said second circuit means includes an anti-graffiti coating disposed thereon.

14. The illuminated touch switch according to claim 1 wherein said top surface of said second circuit means includes an indicia portion disposed thereon, said indicia portion being one of text, graphic and a combination thereof.

15. The illuminated touch switch according to claim 1 wherein said control circuit means includes at least one diode disposed intermediate said at least one voltage source means and said at least one light source for providing a reverse polarity protection.

16. The illuminated touch switch according to claim 1 wherein each of said at least one voltage source means, at least one ground source means and at least one switch power source is one of at least one battery source disposed within said control circuit means, a plurality of external electrical connections electrically coupled to said plurality of associated internal electrical connection means and a combination thereof.

17. The illuminated touch switch according to claim 16 wherein each of said plurality of external electrical connections is a plurality of electrical wires coupled to said plurality of associated internal electrical connection means of said control circuit means at one end and having a distal end being one of bare wire, terminal connection and connector means.

18. The illuminated touch switch according to claim 1 wherein a transmittal of said at least one switch output signal is enabled by one of a transmitter wirelessly communicating with remotely mounted receiver, an external electrical connection electrically coupled to a switch output source means and a combination thereof.

19. The illuminated touch switch according to claim 1 wherein said plurality of internal electrical connection means is an edge connector integrally disposed within said first circuit means.

20. The illuminated touch switch according to claim 1 wherein said spacer means is an acrylic adhesive.

21. The illuminated touch switch according to claim 1 wherein said illuminated touch switch further includes a cover member engaging said top surface of said second circuit means, said cover means having a plurality of apertures associated with said at least one light source, said touch sensitive area and said mounting means.

22. The illuminated touch switch according to claim 1 wherein said illuminated touch switch further includes a first sealing means engaging said bottom surface of said first circuit means and having a first surface, a second surface and an aperture enabling passage of said plurality of external electrical connections.

23. The illuminated touch switch according to claim 22 wherein said first sealing means is manufactured from a material being one of a rubberized compound and a silicone material.

24. The illuminated touch switch according to claim 22 wherein said first sealing means includes an adhesive disposed on said first surface for bonding to said bottom surface of said first circuit means.

25. The illuminated touch switch according to claim 1 wherein said illuminated touch switch further includes an edge sealing means being one of a perimeter flange extending outwardly from said cover member, a perimeter flange extending outwardly from said first sealing means and an epoxy material applied to a perimeter edge of said illuminated touch switch.

26. The illuminated touch switch according to claim 1 wherein said illuminated touch switch further includes a second sealing means having a plurality of apertures and disposed intermediate said second electrical circuit means and said cover member.

27. The illuminated touch switch according to claim 1 wherein said mounting means is one of at least one mounting aperture, adhesive disposed on said second surface of said first sealing means and a combination thereof.

28. In combination with a transit vehicle having at least one door for passenger ingress and egress, a floor portion adjacent said door and a screen member separating a seating area from said floor portion, the improvement comprising at least one touch switch having a touch sensitive area and at least one illumination means, said touch switch attached to one of said door, said floor portion, said screen member and a combination thereof for enabling a passenger to visually identify said door in a condition enabled for opening and to initiate opening of said door by applying a touch contact pressure to said touch sensitive area.

29. The transit vehicle according to claim 28 wherein said transit vehicle further includes at least one switch cavity of predetermined size and predetermined thickness disposed in one of said door, said floor portion, said screen member, and a combination thereof for enabling a recessed attachment of said at least one illuminated touch switch.

30. The transit vehicle according to claim 28 wherein said illuminated touch switch having at least a planar top surface.

* * * * *